US010745977B2

(12) United States Patent
Boike

(10) Patent No.: US 10,745,977 B2
(45) Date of Patent: Aug. 18, 2020

(54) DOUBLE DRILL ROD SECTION, DOUBLE DRILL ROD LENGTH AND METHOD OF PRODUCING AN ELECTRICALLY CONDUCTIVE CONNECTION IN A DOUBLE DRILL ROD SECTION

(71) Applicant: TRACTO-TECHNIK GmbH & Co. KG, Lennestadt (DE)

(72) Inventor: Volker Boike, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 256 days.

(21) Appl. No.: 15/552,046

(22) PCT Filed: Feb. 15, 2016

(86) PCT No.: PCT/EP2016/000253

§ 371 (c)(1),
(2) Date: Aug. 18, 2017

(87) PCT Pub. No.: WO2016/131533

PCT Pub. Date: Aug. 25, 2016

(65) Prior Publication Data

US 2018/0038170 A1 Feb. 8, 2018

(30) Foreign Application Priority Data

Feb. 19, 2015 (DE) ..... 10 2015 001 969

(51) Int. Cl.
*E21B 17/02* (2006.01)
*E21B 7/04* (2006.01)
(Continued)

(52) U.S. Cl.
CPC ..... *E21B 17/028* (2013.01); *E21B 7/046* (2013.01); *E21B 7/062* (2013.01); *E21B 17/003* (2013.01); *E21B 17/18* (2013.01); *H01R 39/64* (2013.01)

(58) Field of Classification Search
CPC .... E21B 41/0085; E21B 47/09; E21B 17/028; E21B 17/04; E21B 17/18; E21B 7/062;
(Continued)

(56) References Cited

U.S. PATENT DOCUMENTS 5,468,153 A * 11/1995 Brown ..... E21B 17/028 439/13
8,342,865 B2 * 1/2013 Scheibelmasser .... E21B 17/028 439/191
(Continued)

FOREIGN PATENT DOCUMENTS

DE 10313758 A1 10/2004
DE 102011103220 B3 10/2012
(Continued)

OTHER PUBLICATIONS

International Search Report dated Apr. 14, 2016 for related PCT Application No. PCT/EP2016/000253.

*Primary Examiner* — Robert E Fuller
*Assistant Examiner* — Christopher J Sebesta
(74) *Attorney, Agent, or Firm* — Howard IP Law Group, PC

(57) ABSTRACT

A double drill rod section has an outer drill rod section and an inner drill rod section. The inner drill rod section has at least one conductor. In order to bring about an electrical connection of the conductor, the inner drill rod section has an essentially annular outer contact, and, in the annular space between the outer drill rod section and the inner drill rod section, a pick-up is in contact with the annular outer contact of the inner drill rod section.

21 Claims, 3 Drawing Sheets

(51) Int. Cl.

| | |
|---|---|
| ***E21B 7/06*** | (2006.01) |
| ***H01R 39/64*** | (2006.01) |
| ***E21B 17/00*** | (2006.01) |
| ***E21B 17/18*** | (2006.01) |

(58) Field of Classification Search
CPC ..... E21B 43/045; E21B 43/08; E21B 17/003; E21B 7/046; H01R 39/64
See application file for complete search history.

(56) References Cited

U.S. PATENT DOCUMENTS

| | | | | |
|---|---|---|---|---|
| 9,291,008 | B2 | 3/2016 | Koch et al. | |
| 2001/0012703 | A1 | 8/2001 | Wurm et al. | |
| 2002/0185315 | A1* | 12/2002 | McLoughlin | E21B 7/062 175/76 |
| 2007/0018847 | A1* | 1/2007 | Hall | E21B 17/028 340/853.1 |
| 2008/0166917 | A1* | 7/2008 | Hall | E21B 17/028 439/583 |
| 2013/0014992 | A1* | 1/2013 | Sharp | E21B 47/024 175/45 |
| 2014/0055278 | A1* | 2/2014 | Chau | E21B 47/00 340/854.4 |
| 2015/0275626 | A1* | 10/2015 | Jenne | E21B 41/0085 175/45 |

FOREIGN PATENT DOCUMENTS

| | | | |
|---|---|---|---|
| EP | 0909876 | A2 | 4/1999 |
| EP | 2957710 | A1 | 12/2015 |
| JP | 2013007241 | A | 1/2013 |

* cited by examiner

DOUBLE DRILL ROD SECTION, DOUBLE DRILL ROD LENGTH AND METHOD OF PRODUCING AN ELECTRICALLY CONDUCTIVE CONNECTION IN A DOUBLE DRILL ROD SECTION

CROSS-REFERENCE TO RELATED APPLICATIONS

This application is a national phase application under 35 U.S.C. § 371 of International Patent Application No. PCT/EP2016/000253 filed Feb. 15, 2016, which claims priority to German Application No. 10 2015 001 969.4 filed Feb. 19, 2015, the entire contents of all of which are incorporated herein by reference for all purposes.

FIELD OF THE INVENTION

The invention relates to a double drill rod section, a double drill rod length and a method of producing an electrically conductive connection in a double drill rod section.

BACKGROUND OF THE INVENTION

In rod-based drilling in the ground, in particular to produce to horizontal borings, a drill head of a drilling rod is driven by a drive device situated on the surface or in a construction pit. The drill rods used consist of individual drill rod lengths connected to each other, which according to the course of the drilling are successively applied to the rear end of the already drilled-in drilling rod and connected thereto.

For rock drilling, i.e. drilling in rock or stone formations, a double drill rod or double rod is used. In these drilling devices the drilling head is additionally driven in a rotating manner via an inner rod of the double drill rod from the drive device arranged on the surface or in the construction pit which also ensures advancing of the drilling head. For this the inner rod is borne in a rotatable manner within an outer rod of the double drill rod. In double drill rods the individual rod lengths both of the outer rod and the inner rod are either screwed to each other or inserted into each other.

To supply electrical consumers in the double drill rod and/or to transmit signals it is necessary to provide electrical connections within the double drill rod. For this it is known to use a conductor or a cable which extends along the inside of the inner drill rod.

A drawback of the existing provision of electrical connections is that the electrical connection for conducing electrical energy—for supplying electrical voltage or power and/or for transmitting data—can only take place in the inner drill rod assembly as it has hitherto been assumed that the conductor or cable has to be protected in the inner drill rod.

SUMMARY OF THE INVENTION

On the basis of this prior art, the aim of the invention was to create an improved double drill rod section, an improved drill rod length and an improved method of producing an electrically conductive connection in a double drill rod section in which an electrical connection is also possible in the annular space between the inner drill rod and the outer drill rod.

This aim is achieved by the subject matter disclosed herein. Advantageous further developments of the subject matter are also set out in the following description.

The core concept of the invention is to lead the at least one conductor provided in the inner drill rod section out from the inner drill rod section in such a way that a pick-up present in the annular space between the inner drill rod assembly and the outer drill rod section is in contact with an outer contact formed on the inner drill rod section. An outer contact is present on the inner drill rod section which is essentially annularly formed around the circumference of the inner drill rod section. The outer contact can be electrically connected to the at least one conductor of the inner drill rod section and the electrical signal and/or the current or the voltage can be tapped by means of the pick-up present in the annular space between the inner drill rod assembly and the outer drill rod section as the pick-up is in contact with the annular outer contact of the inner drill rod assembly.

The outer contact is essentially annularly formed around the circumference of the inner drill rod section which means that the outer contact is designed in an enclosed manner around the circumference of the inner drill rod along the circumference. The extent of the outer contact in the longitudinal direction of the inner drill rod/inner drill rod section can be in any form. For example, the outer contact can be designed as a strip placed around the inner drill rod section. The strip can be of a same width along the circumference. The extent of the pick-up in the direction of the longitudinal axis of the inner drill rod is preferably the same or smaller than the extent of the outer contact in the longitudinal direction of the inner drill rod.

According to the invention, the double rod section can be a double drill rod section of an earth drilling device. The term "section" is defined as an area of the double drill rod in the longitudinal direction. A "drill rod length" can be understood by the term "drill rod section". "Earth drilling device" in particular refers to a device which moves a double drill rod in an existing or planned channel in the ground in order to produce or expand a boring, more particularly a horizontal boring or in order pull lines or other long elements into the ground. The earth drilling device can, in particular, refer to an HD device (horizontal drilling).

The term "conductor" according to the invention covers an electrically conductive conductor which can be designed as a cable, i.e. with an at least partially present insulation which surrounds the conductor.

More particularly, in a double drill rod section according to the invention drilling fluid can be conveyed at least in parts through the inside of the inner drill rod and/or the annular space between the inner drill rod and outer drill rod. This creates more difficult conditions for the transmission of electrical signals.

In a preferred form of embodiment the at least one conductor is sealed off in the region of the annular outer contact in the inner drill rod section. The term "sealed off" according to the invention in particular covers the sealing off of one area from the drilling fluid present in the double drill rod at least in parts. To create the seal a sealing means can be present in the inner drill rod section which prevents the penetration of drilling fluid into the area of the inner drill rod section in which the at least one conductor is connected to the outer contact. Additionally and/or alternatively it can be envisaged that before sealing off the area in which the at least one electrical conductor is connected to the outer contact, pressure release is carried out in that in front of this region or before the sealing means at least one through boring is present in the inner drill rod which creates a fluidic connection between the inner space of the inner drill rod and the annular space between the inner drill rod and the outer drill rod.

In a preferred form of embodiment the outer area of the inner drill rod section is sealed off in the area of the outer contact by means of spaced sealing elements in the longitudinal direction of the double drill rod section. In this way it can be prevented that electrical currents flow via the drilling fluid present at least in parts in the double drill rod.

In a preferred form of embodiment the pick-up is sealed off from the annular space between the inner drill rod section and outer drill rod section so that unwanted electrical (creep) currents can be reduced.

Preferably the outer contact is electrically insulated with regard to the inner drill rod section. For electrically insulating the outer contact from the inner drill rod, an insulating layer can be present between the outer contact and the inner drill rod which can be designed as an insulating sleeve. The outer contact can be connected to the inner drill rod in a torque-free manner via the insulating layer.

In a particularly preferred form of embodiment a double drill rod length can be created which comprises an aforementioned double drill rod section and in the annular space between the inner drill rod and outer drill rod has probe. The probe can be connected to the outer drill rod and connected by means of at least one conductor to the pick-up.

A method of producing an electrically conductive connection in a double drill rod section is also created wherein the electrically conductive connection between an interior of an inner drill rod section and the annular space between the inner drill rod section and outer drill rod section is produced. An essentially annular outer contact is provided on the inner drill rod and an conductor, provided in the interior of the inner drill rod section, is connected to the annular outer conductor, wherein a pick-up, arranged in the annular space, which is in contact with the outer contact, is moved over the outer contact in conducing contact.

The above embodiments, as well as the following description of an example form of embodiment do not constitute any relinquishment of certain forms of embodiment or features.

BRIEF DESCRIPTION OF THE DRAWINGS

The invention will be described in more detail below by way of an example of embodiment shown in the drawings. In the drawings.

DETAILED DESCRIPTION

Figure 2:
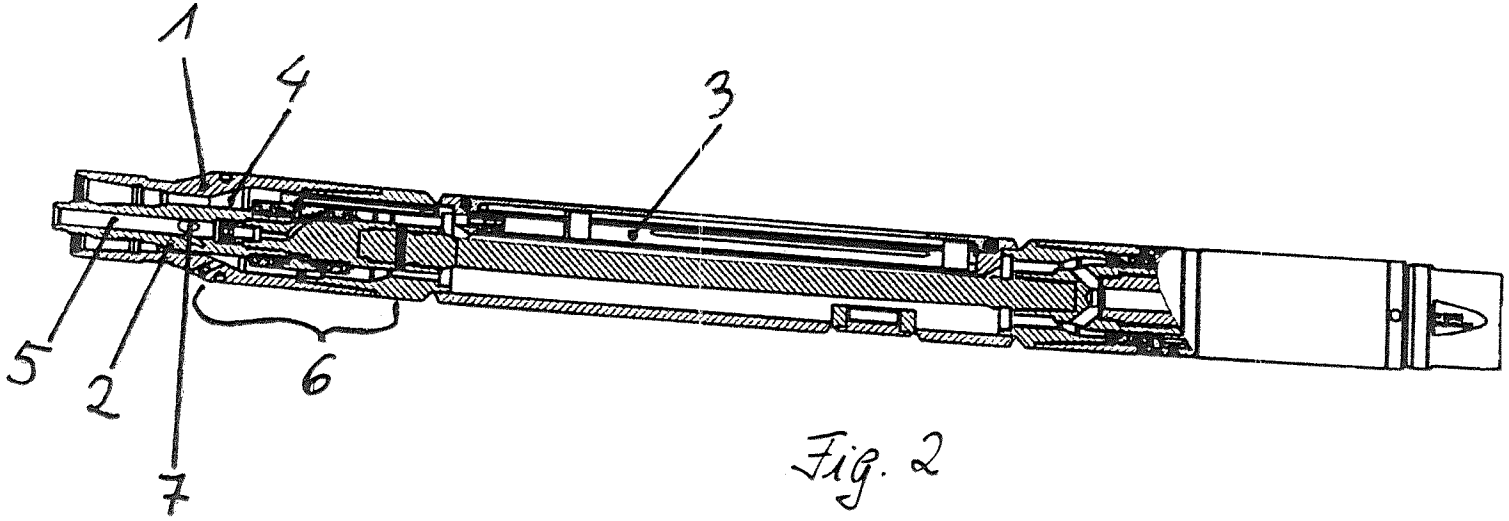
FIG. 2 shows a partial cross-sectional view of FIG. 1.
Figure 1:
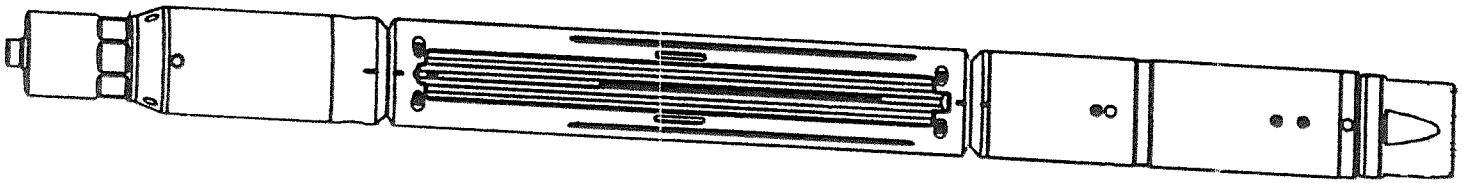
FIG. 1 shows side view of a double drill rod assembly according to the invention.

FIGS. 1 and 2 show a front section of a double drill rod. FIGS. 1 and 2 show a double drill rod section 6 with an outer rod section 1 and an inner rod section 2 wherein an electrical connection is produced from the inside of the inner drill rod section 2 to the annular space 4 between the inner drill rod section 2 and the outer drill rod section 1. By means of the electrical connection in the double drill rod section 6 a probe 3 eccentrically present in the double drill rod can be provided with energy and/or data. Transmission of the energy and/or data in the direction of the probe 3 and/or bidirectionally to the probe 3 and from the probe 3 is possible. The double drill rod section 6 can make possible the function of transmitting energy and/or data between interior of the inner drill rod and the annular space 4 between the inner drill rod and outer drill rod.

The probe 3 is located in a probe housing which is connected to the outer drill rod. The inner drill rod can rotate and drive a drilling head within the outer drill rod independently of the rotational movements of the outer drill rod. A desired drilling direction can be set via the rotation of the outer drill rod. The probe 3, which moves with the outer drill rod, can record certain values, for example the angle of roll or the inclination of the double drill rod and transmit these to a further unit known from the prior art. Transmission can take place wirelessly and/or via cables.

Figure 3:
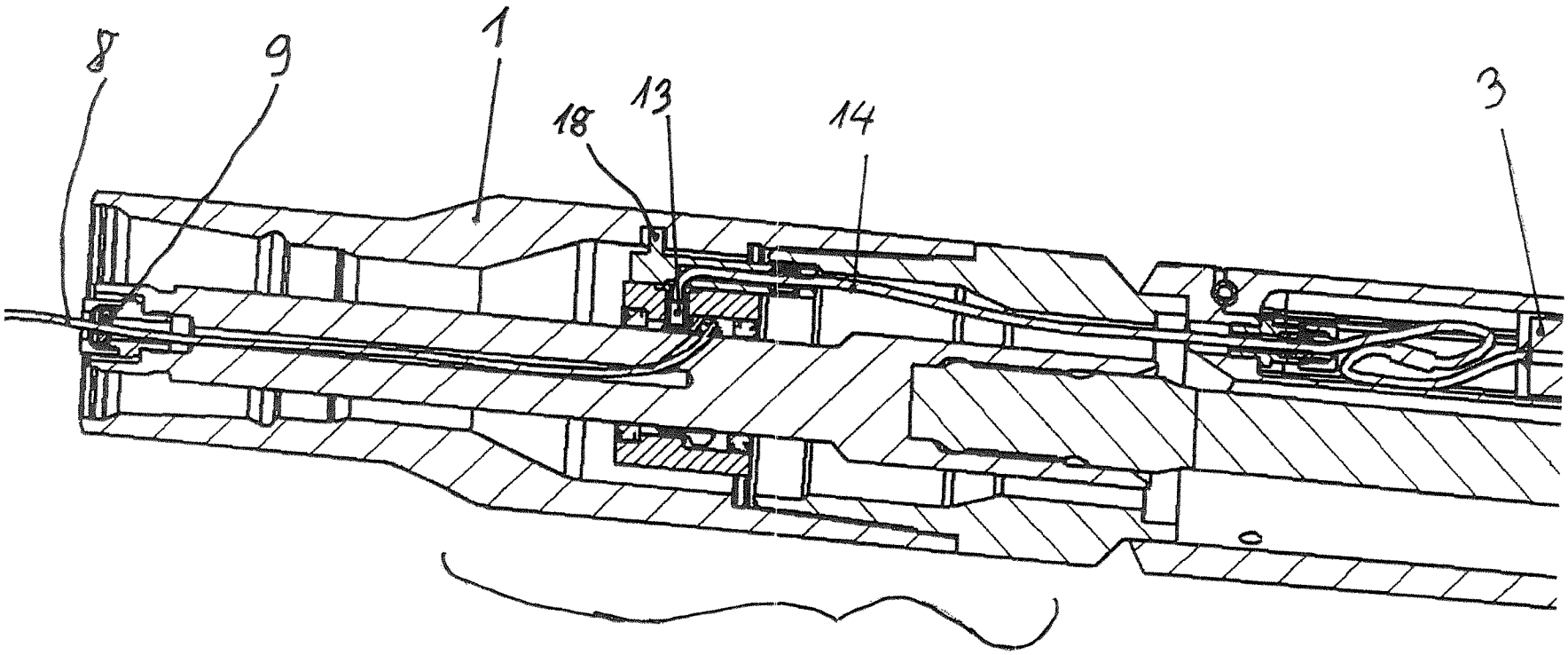
FIG. 3 shows a cross-sectional view of an enlarged section of FIG. 2.
Figure 4:
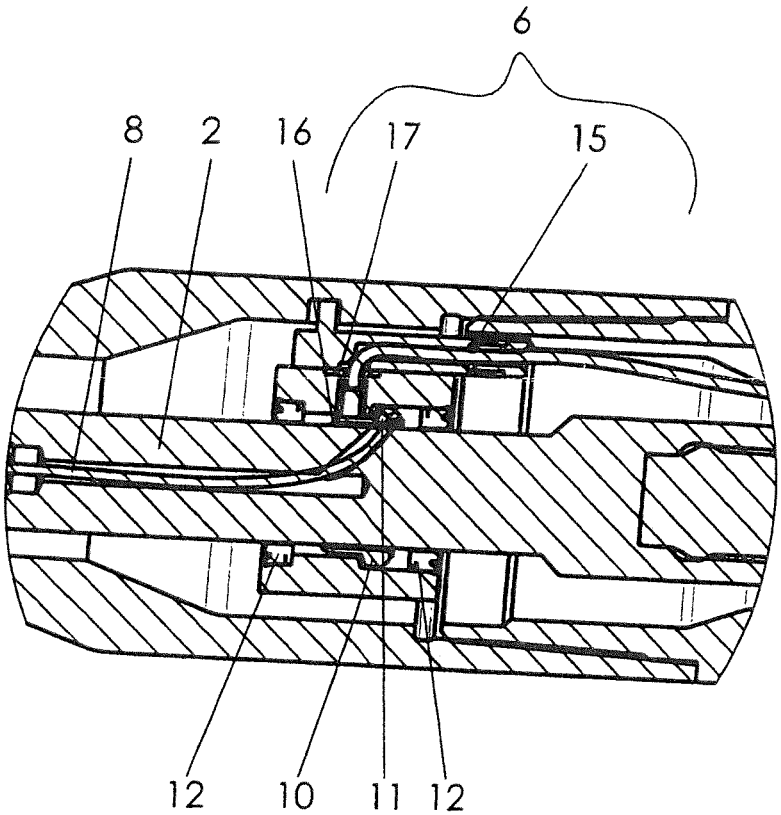
FIG. 4 shows a partial view of a further enlargement of FIG. 3.

In the interior 5 of the hollow inner drill rod there is a conductor 8 or cable (cf. FIG. 3) via which transmission of data and/or energy can take place. In the double drill rod section 6 the conductor 8 or the cable can be taken out via a boring and electrically connected with an annular outer contact 10 designed as a slip ring. The annular outer contact 10 comprises an electrically insulating sleeve 16 which sits firmly on the inner drill rod section. Through this the annular outer contact is electrically insulated with regard to the inner drill rod section. The conductor taken out from the inner drill rod section is clamped to the annular outer contact, wherein in the shown example of embodiment of FIGS. 3 and 4 a screw 11 is used.

An electrically conducting pick-up 13 is in contact with the outer contact. In addition to the described form of embodiment several pick-ups 13 can also be used. The pick-up(s) 13 is/are arranged in an isolating sleeve 17 made of non-conductive material. A further conductor 14, with which the probe 3 can be connected, is connected to the pick-up(s) 13. The energy or the data present on the conductor 8 can be transmitted to the further conductor 14.

In drilling operation drilling fluid is conveyed during advancing of the drilling, initially to avoid pressure losses through the ever lengthening drill rod, via the annular space 4 between the inner rod and the outer rod as well as through the interior of the inner drill rod. Drilling fluid is taken in the direction of the drilling head, before the double drill rod section in which the electrical connection between the at least one conductor 8 and the outer contact is produced, through borings 7 leading outwards in the inner drill rod which results in the drilling fluid being guided from the inner drill rod on the last section to the drilling head also via the annular space 4. In the direction of flow of the drilling fluid, behind the borings 7 of the double drill rod section conductor 8 located in the inner drill rod and rotating with it is sealed off from the exerted drilling fluid pressure by way of a sealing means 9.

The section of the double drill rod in the region of the annular outer contact is sealed off by way of two sealing elements 12, designed as sealing rings, spaced in the longitudinal direction of the double drill rod section. Also present is a further sealing means 15, designed as a sealing ring, which surrounds the further conductor 14. In the example of embodiment shown in the figures the pick-up(s) 13 is/are connected to the outer drill rod section in a torque-free manner through which a rotational movement relative to the outer drill rod is prevented. A torque support 18 is present which prevents a rotational movement of the pick-up(s) 13. The pick-up(s) (13) is/are moved over the annular outer contact, following the rotational movement of the outer drill rod.

The invention claimed is:

1. A double drill rod section comprising:

an outer drill rod section;

an inner drill rod section at least partly within the outer drill rod section, and having a hollow interior, comprising:

at least one conductor in the hollow interior, and an outer contact electrically coupled to the at least one conductor, a pick-up, in an annular space between the outer drill rod section and the inner drill rod section, said pick-up in contact with the outer contact of the inner drill rod section; and wherein a sealing element is disposed in a first end of the hollow interior of the inner drill rod section about the at least one conductor and adapted to prevent penetration of drilling fluid via the first end of the hollow interior of the inner drill rod section into an area of the hollow interior, spaced apart from the first end of the hollow interior of the inner drill rod section, in which the at least one conductor is routed through a wall of the inner drill rod section and coupled to the outer contact.

2. The double drill rod section of claim 1, wherein the outer contact of the inner drill rod section is coupled to the least one conductor by at least one of a clamp and a screw.

3. The double drill rod section of claim 1, further wherein the outer contact is annularly formed around an outer circumference of the inner drill rod section.

4. The double drill rod section of claim 1, wherein a longitudinal width of the pick-up is no greater than a longitudinal width of the outer contact.

5. The double drill rod section of claim 1, wherein the inner drill rod section further comprises a seal for sealing the at last one conductor from drilling fluid in a region of the outer contact.

6. The double drill rod section of claim 5, wherein the seal comprises a first seal and a second seal longitudinally spaced along the inner drill rod section such that the first seal is on one side of the outer contact and the second seal is on an other side of the outer contact to seal the region of the outer contact.

7. The double drill rod section of claim 6, further comprising a third seal sealing the pick-up from the annular space between the inner drill rod section and the outer drill rod section.

8. The double drill rod section of claim 1, wherein the inner drill rod section further comprises one or more passages configured for conveying drilling fluid from the hollow interior of the inner drill rod section to the annular space between the outer drill rod section and the inner drill rod section.

9. A double drill rod length comprising:

a double drill rod section, comprising:

an outer drill rod section;

an inner drill rod section within the outer drill rod section, configured to rotate independently of the outer drill rod section, and having a hollow interior, an annular space being defined between the inner drill rod section and the outer drill rod section, comprising:

at least one first conductor within the hollow interior, and an annular outer contact electrically coupled to the at least one first conductor, and one or more pick-ups, in the annular space between the outer drill rod section and the inner drill rod section, said one or more pick-ups in contact with and in electrical communication with the annular outer contact of the inner drill rod section;

a sealing element disposed in a first end of the hollow interior of the inner drill rod section about the at least one conductor and adapted to prevent penetration of drilling fluid via the first end of the hollow interior of the inner drill rod section into an area of the hollow interior, spaced apart from the first end of the hollow interior of the inner drill rod section, in which the at least one conductor is routed through a wall of the inner drill rod section and coupled to the outer contact;

a probe in the annular space between the inner drill rod section and the outer drill rod section, said probe electrically connected to the one or more pick-ups.

10. The double drill rod length of claim 9, wherein the probe is connected to the outer drill rod section to move with the outer drill rod section.

11. The double drill rod length of claim 9, wherein the annular outer contact comprises a slip ring.

12. The double drill rod length of claim 9, further comprising a nonconductive insulating sleeve between the annular outer contact and the inner drill rod.

13. The double drill rod length of claim 9, wherein the at least one first conductor is at least one of clamped or screwed to the outer contact.

14. The double drill rod length of claim 9, further comprising a first sealing ring and a second sealing ring longitudinally-spaced along the inner drill rod section such that the first sealing ring is on one side of the outer contact and the second sealing ring is on an other side of the outer contact to seal off an area surrounding the outer contact.

15. The double drill rod length of claim 14, further comprising a third sealing ring surrounding a probe conductor connecting the probe and the one or more pick-ups.

16. The double drill rod length of claim 9, further comprising a nonconductive insulating pickup sleeve, wherein the one or more pick-ups are arranged in the nonconductive insulating pickup sleeve.

17. The double drill rod length of claim 9, further comprising a probe conductor, wherein the probe is connected to the one or more pick-ups by the probe conductor.

18. The double drill rod length of claim 9, further comprising a torque support which prevents rotational movement of the one or more pick-ups relative to the outer drill rod section.

19. A method of producing an electrically conductive connection in a double drill rod section comprising:

providing an annular outer contact on an outer circumference of an inner drill rod section within an annular space between the inner drill rod section and an outer drill rod section, the annular outer contact electrically connected to a first conductor within the inner drill rod section;

disposing a seal in a first end of the hollow interior of the inner drill rod section about the at least one conductor to prevent penetration of drilling fluid via the first end of the hollow interior of the inner drill rod section into an area of the hollow interior, spaced apart from the first end of the hollow interior of the inner drill rod section, in which the at least one conductor is routed through a wall of the inner drill rod section and coupled to the outer contact; and moving a pick-up arranged in the annular space between the inner drill rod section and the outer drill rod section such that the pick-up is in contact with the annular outer contact, the pick-up electrically connected to a second conductor, the second conductor electrically connected to a probe mounted on the outer drill rod section.

20. The method of claim 19, further comprising fixing a rotational position of the pick-up with a torque support.

21. The method of claim 19, further comprising conveying, by one or more passages on the inner drill rod section, drilling fluid from the hollow interior of the inner drill rod section to the annular space between the outer drill rod section and the inner drill rod section.

* * * * *